US006654573B2

(12) United States Patent
Carlson et al.

(10) Patent No.: US 6,654,573 B2
(45) Date of Patent: Nov. 25, 2003

(54) PAPER TRAY MOISTURE CONTROL

(75) Inventors: Gerard J. Carlson, Boise, ID (US); Travis J. Parry, Boise, ID (US); Robert Sesek, Meridian, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 10/079,982

(22) Filed: Feb. 21, 2002

(65) Prior Publication Data

US 2003/0156871 A1 Aug. 21, 2003

(51) Int. Cl.[7] ..... G03G 15/00
(52) U.S. Cl. ..... 399/92; 399/97; 399/390
(58) Field of Search ..... 399/44, 92, 97, 399/390, 393; 271/3.03, 3.05, 9.01, 11

(56) References Cited

U.S. PATENT DOCUMENTS 4,306,802 A * 12/1981 Kucera et al. ..... 399/390
5,103,264 A * 4/1992 Bhagat ..... 399/253
5,600,427 A * 2/1997 Watanabe et al. ..... 399/97
5,930,558 A * 7/1999 Raus, Sr. et al. ..... 399/97

* cited by examiner

*Primary Examiner*—William J. Royer

(57) ABSTRACT

A moisture-reducing paper tray including a desiccant that absorbs moisture from the environment of the paper tray and consequently the paper supply itself. As a result, the desiccant may become saturated as moisture is adsorbed. In one embodiment of the invention, the desiccant may be changed for a fresh desiccant. In an alternate embodiment of the invention, the moisture-reducing paper tray may also include a drying mechanism which includes a heating element, a blower and a humidity sensor. The humidity sensor is positioned to sense a humidity level in the paper tray. When a pre-selected humidity level in the paper tray is equaled or exceeded, the heating element and blower are energized and warm air passes into the paper tray drying the desiccant.

18 Claims, 6 Drawing Sheets

PAPER TRAY MOISTURE CONTROL

BACKGROUND OF THE INVENTION

1. Technical Field

The present invention relates generally to imaging devices and printers, and more specifically to an apparatus for conditioning the moisture content of printing media.

2. Background Art

Imaging devices generally consist of a printing system, for example an ink-jet, laser-printing, or photocopying system, and a media transfer system which moves media, usually paper, along a path. The paper path generally directs paper from a tray containing fresh unused paper, through the process steps of the printing system, and out of the imaging device. The paper path often involves complicated manipulation of the paper through tight spaces and around corners, and the paper must be moved precisely along this path in order to assure accurate image replication. With features such as double-sided copying/printing or output collation, paper path accuracy becomes even more important.

The moisture content of the paper within the system is an important factor for correct operation of the media transfer system. Overly moist paper becomes limp and can more easily wrinkle, contributing significantly to the occurrence of misalignment, low-quality output, and time-consuming paper jams. Overly moist paper may also adhere to adjoining sheets of paper resulting in multiple sheets being picked simultaneously; resulting in jams as well as poor print quality. Additionally, the heating elements present in thermal or toner-based printing systems tend to heat paper unevenly and cause overly moist paper to curl, exacerbating paper path accuracy problems and jamming. Excessive moisture in electronic printing systems can also cause corrosion, clumping of toner, and due to variations in absorption rates, decreased output quality. Thus, decreasing the moisture content in the paper prior to transfer through the system can increase print quality and decrease misalignment and jamming.

The process of electrostatic imaging, whether in an electrophotographic copier, a laser printer, or other similar imaging device, typically involves the light-directed distribution of electrostatic charge over the surface of a photoconductive roller. A developing device deposits toner particles on the photoconductive roller and the toner particles are in turn deposited as an image onto a sheet media. After the image is transferred to the sheet media, the media typically passes between a fuser roller and a pressure roller where the media and toner are heated and pressed bonding the image onto the media. All media contain moisture. When the media passes between the rollers, at least a portion of the moisture is heated and evaporates. The resulting vapor may be transported to the various systems of the imaging device having a potentially detrimental effect upon those systems.

Prior art approaches to achieving moisture content reduction in imaging devices include pre-heating the paper along the paper path to decrease moisture content. If done as a preliminary step along the paper path, heating the paper can cause curling and jamming. Heaters and blowers that run nearly full time consume excess energy and further complicate the paper path. If no moisture-management system is used, the imaging system may have to be operated in a humidity-controlled environment.

The environment in which a device operates, including the temperature and relative humidity of the working environment, may affect overall device performance and life cycle. There may be advantageous affect to device performance and life cycle by conditioning a sheet media for use in an imaging device and controlling the moisture content of the sheet media while stored for use in a paper tray or cassette. Therefore, it may be advantageous to provide a system for removing moisture from paper without complicating the path of paper through the imaging device. It may also be advantageous to provide an energy efficient moisture removal system. Additionally, it may be advantageous to provide a simple and cost-efficient system. Advantage may also be found in providing a system that dries paper without subjecting it to unnecessary curling.

SUMMARY OF THE INVENTION

The present invention is directed to a moisture-reducing paper tray. The paper tray includes a desiccant that absorbs moisture from the environment of the paper tray and consequently the paper supply. Desiccants include but are not limited to the compounds including silica gel, activated alumina and lithium chloride salt. A desiccant naturally attracts moisture from gases and liquids. As a result, the desiccant may become saturated as moisture is absorbed or collects in the desiccant material. In one embodiment of the invention, a used desiccant may be changed for a fresh desiccant when required. In an alternate embodiment of the invention, the moisture-reducing paper tray may include a drying mechanism for drying the desiccant thereby eliminating a need to replace the desiccant. The desiccant may be pre-packaged in a packaging film which permits the free transfer of ambient air past the desiccant. Alternately, the paper tray may be lined with a desiccant. In another embodiment of the invention, the desiccant is shaped in a solid form similar to that of the paper within the tray and may be placed below a stack of sheet media stored in the paper tray. In one embodiment of the invention, a paper tray includes a recess formed in the interior of the tray. A desiccant is placed in the recess of the tray. A panel including a plurality of apertures may be placed between the recess and the media and permits air to be passively or actively circulated past the media and the desiccant.

The present invention may also include a drying mechanism for periodically restoring the drying properties of the desiccant. Heating a desiccant permits the material to dry out allowing repeated use. In one embodiment of the invention, heat from a heat source is periodically directed through the paper tray to purge the desiccant of the moisture it has absorbed. In another embodiment of the invention, a vent fan forces air past a heat source and the desiccant purging accumulated moisture. The drying process may operate intermittently, and may be initiated manually, following a pre-selected number of image forming cycles or as a portion of a routine system check. Application of heat to the desiccant may be by means of forced air or by a radiant source. Another embodiment of the invention includes a humidity sensor that monitors the moisture content of the desiccant. The humidity sensor may activate the heat source and/or a fan or blower when the moisture level reaches a pre-selected limit.

Because moisture in the paper tray environment is controlled passively, that is, by control of ambient environmental humidity, and because moisture control occurs when the paper or other media is stored in a relatively heavy stack placed in the tray, curling may be less likely to occur. Controlling or reducing moisture levels in sheet media may decrease the tendency of feed mechanisms to jam. Controlling or reducing moisture levels in sheet media may also reduce humidity and moisture within the imaging device thereby improving device performance, print quality and life cycles.

The present invention consists of the parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

DETAILED DESCRIPTION

Figure 1:
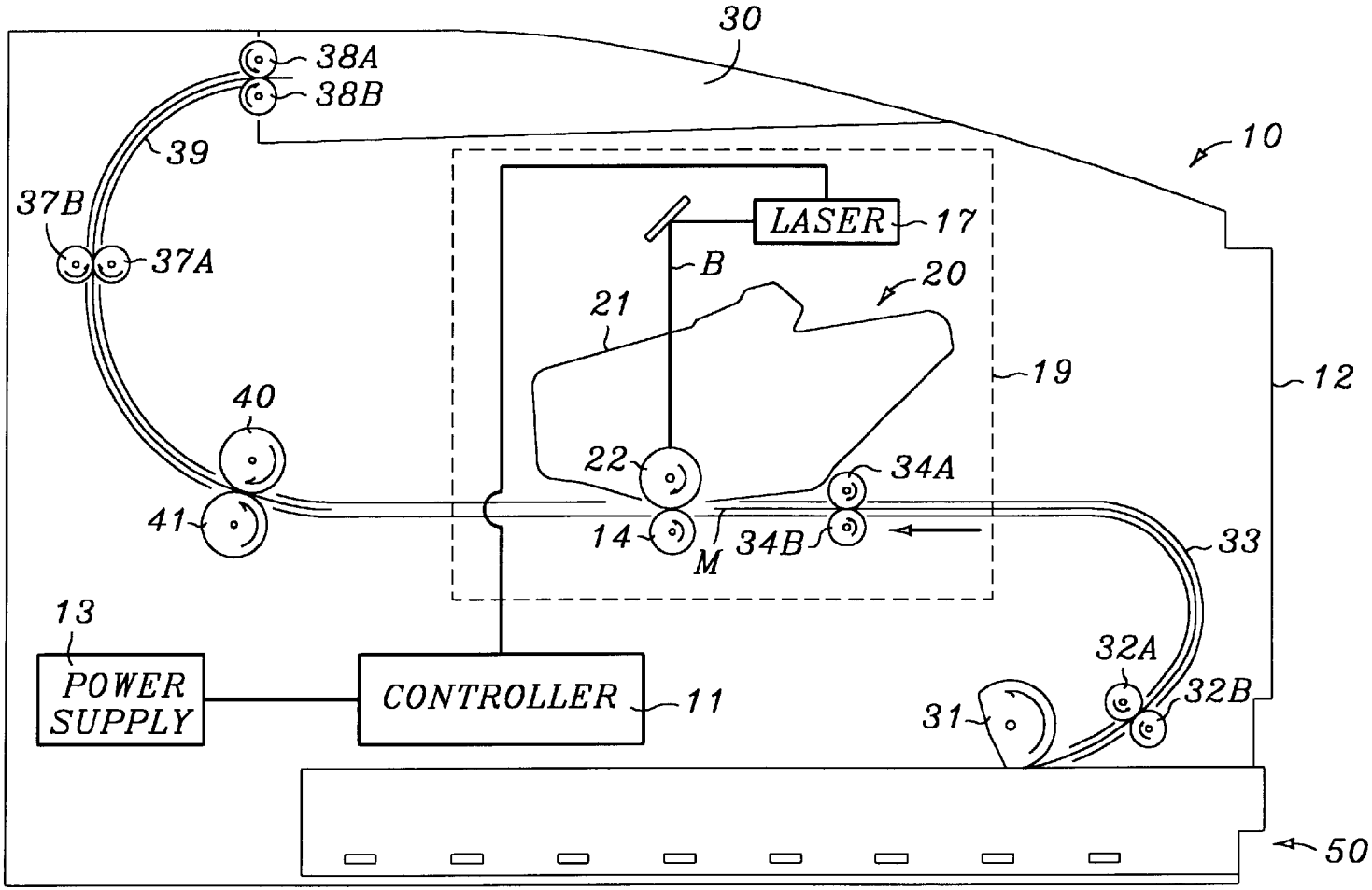
FIG. 1 is a schematic representational side view of an imaging device.
Figure 4:
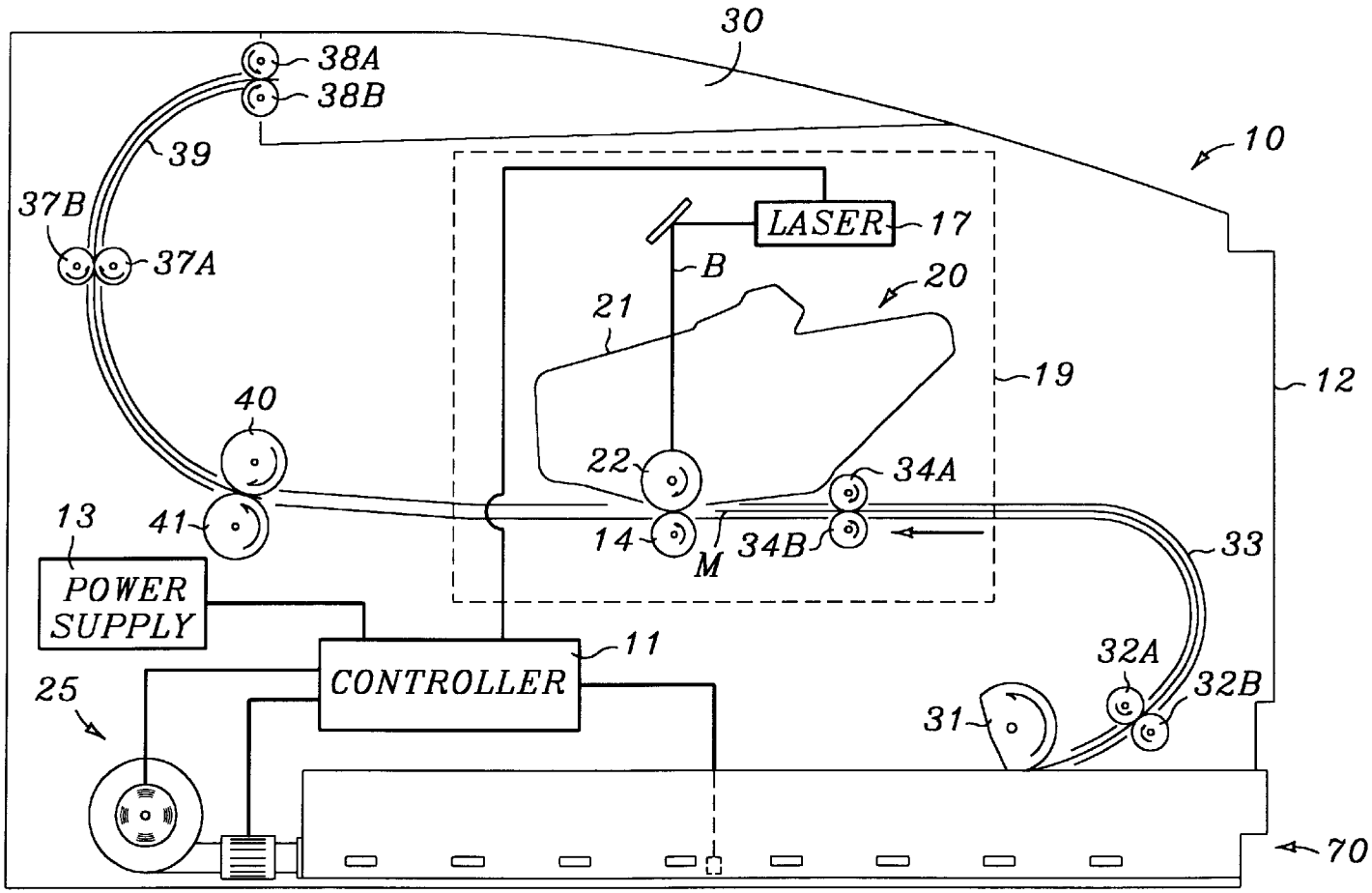
FIG. 4 is a schematic representational side view of an imaging device including a paper tray and a drying mechanism.

Referring to FIGS. 1 and 4, image forming device 10 includes controller 11 contained within housing 12 and which controls various functions of image forming device 10. Power supply 13 provides power to various systems and circuits of image forming device 10. In the embodiment shown, print engine 19 comprises in part scanning laser 17, which emits laser beam B as a scanning sequence of impulses which correspond to processed information input to image forming device 10. While FIGS. 1 and 4 depict a laser type imaging device, it is to be distinctly 10 understood that the invention described herein may be practiced in imaging devices employing a variety of technologies, so long as a paper tray is required for storage of a media supply.

Pickup roller 31 picks and advances the top sheet of media M toward first transport rollers 32A and 32B. First transport rollers 32A and 32B direct media M along input paper path 33 where media M is picked up by second transport rollers 34A and 34B. As shown, developer assembly 20 includes housing 21 enclosing photoconductor drum 22. Media M passes between transfer drum 14 and photoconductor drum 22. Toner is transferred from photoconductor drum 22 to media M between photoconductor drum 22 and transfer drum 14. Following transfer of toner to media M, media M continues through fuser roller 40 and pressure roller 41 where a transferred image is fixed to media M by application of heat and pressure. As shown, media M is next picked up by third transport rollers 37A and 37B and directed along output paper path 39 and is finally discharged to output tray 30 by output rollers 38A and 38B. In FIG. 1, paper tray 50 provides storage for media M.

Referring to FIG. 4, an alternate embodiment of the media moisture control paper tray system for conditioning the moisture content of printing media is shown with paper tray 70 connected to drying mechanism 25.

Figure 2:
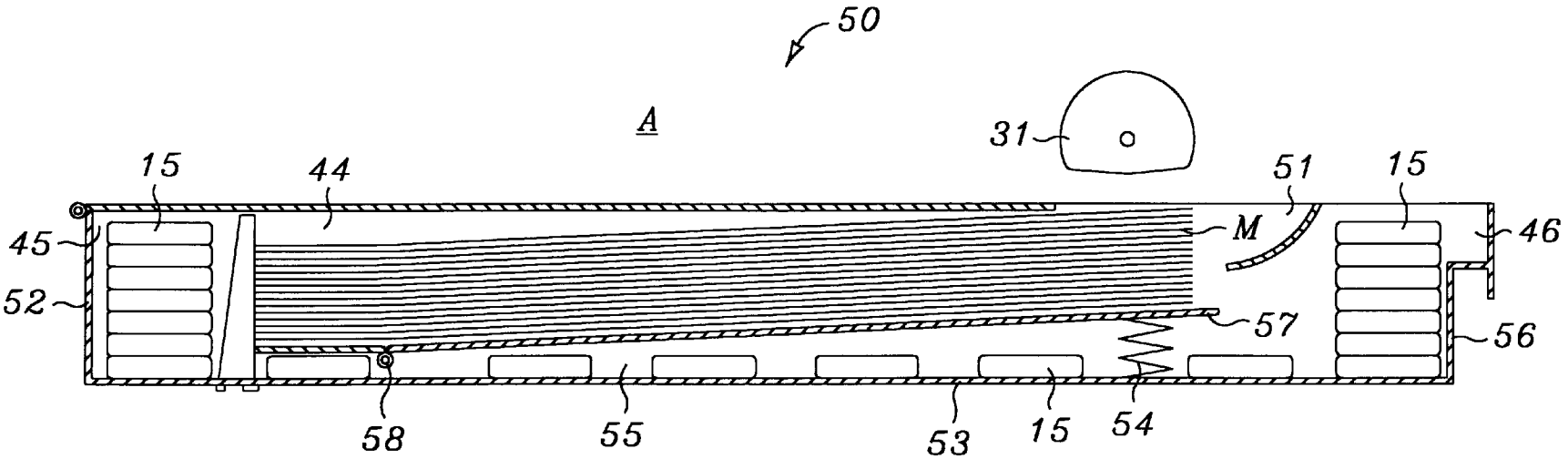
FIG. 2 is a schematic representational side cutaway view of a paper tray including a desiccant.

Referring to FIG. 2, paper tray 50 includes side wall 51, end wall 52, tray face 56 and base panel 53. Spring 54 is disposed between media support panel 57 and base panel 53 and is hingedley attached to base panel 53 by hinge 58. Spring 54 provides an upward bias of media support panel 57 towards pickup roller 31. Recess 55 is formed within the lower portion of paper tray 50. Desiccant packets 15 are placed in recess 55 below media support panel 57. Ambient air A circulates freely between recess 55 containing desiccant packets 15 and media storage bay 44 which contains media M. Desiccant packets 15 are also shown placed in first end bay 45 and second end bay 46.

Figure 3:
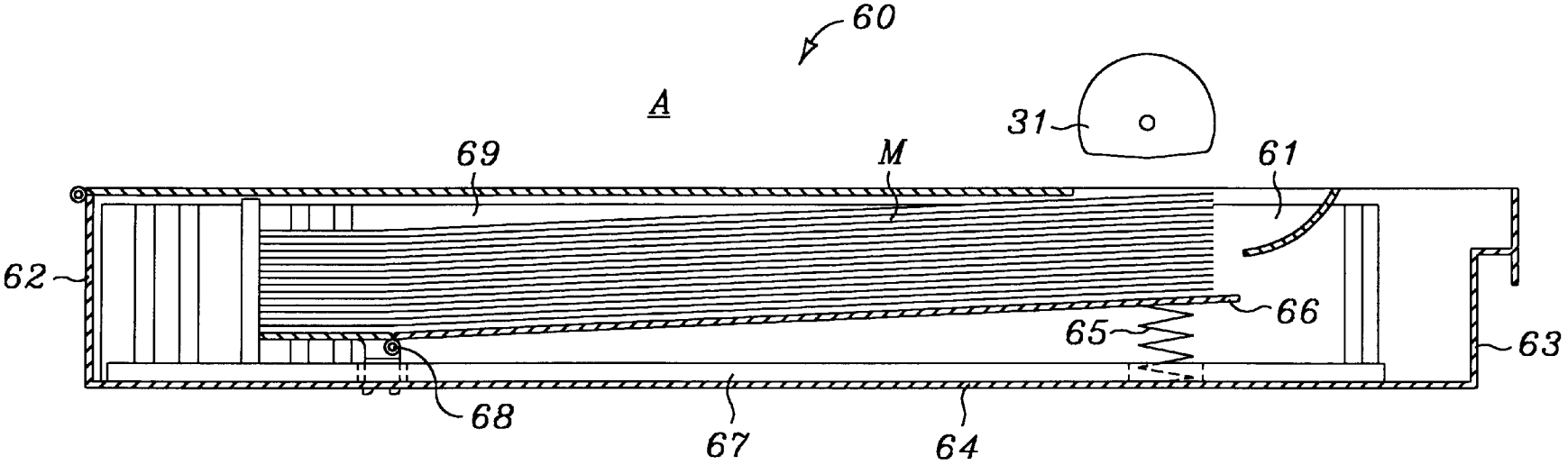
FIG. 3 is a schematic representational side cutaway view of a paper tray including a desiccant.

Referring to FIG. 3, an alternate embodiment of a moisture-reducing paper tray 60 is shown. Paper tray 60 includes side wall 61, end wall 62, front face 63 and base panel 64. Spring 65 is disposed between media support panel 66 and base panel 64 and is hingedley attached to base panel 64 by hinge 68. Spring 65 provides an upward bias of media support panel 66 towards pickup roller 31. In the illustrated embodiment of the invention, a desiccant floor panel 67 is formed of a molded material including a desiccant. Desiccant floor panel 67 is positioned against base panel 64 in the bottom of paper tray 60. Humidity level in media storage bay 69 of paper tray 60 is conditioned by desiccant floor panel 67.

Figure 5:
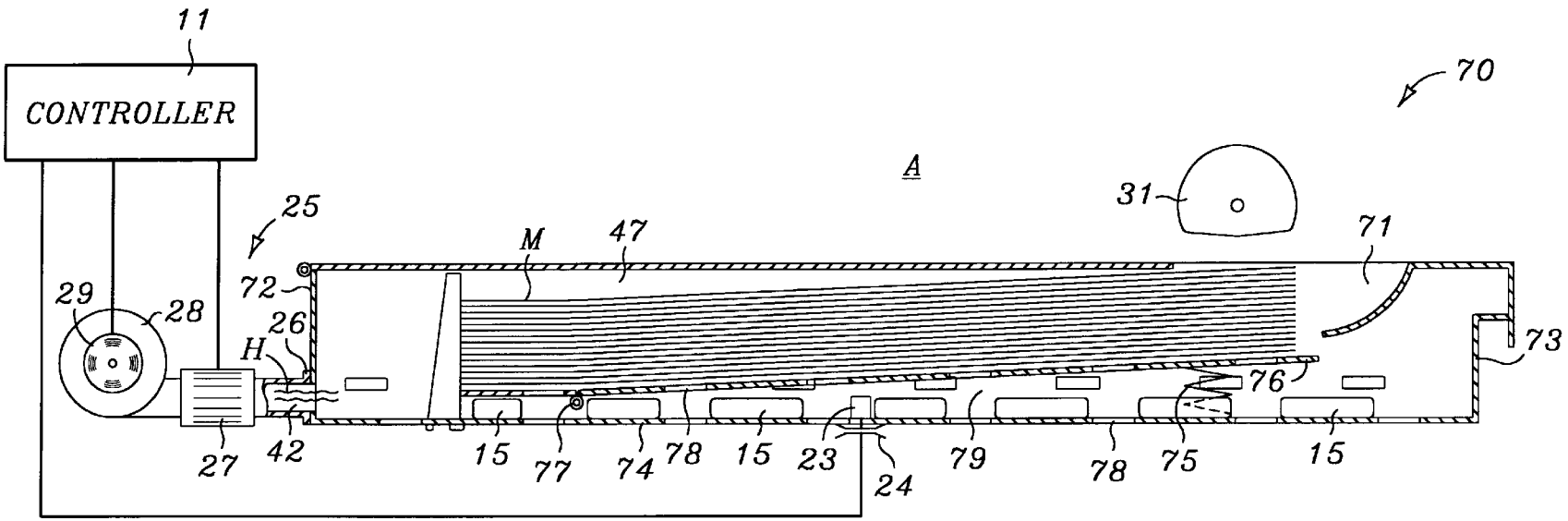
FIG. 5 is a schematic representational side cutaway view of a paper tray including a desiccant and a drying mechanism.

Referring to FIG. 5, paper tray 70 includes side wall 71, end wall 72, tray face 73 and base panel 74. Spring 75 is disposed between media support panel 76 and base panel 74 and is pivotable at hinge 77. Spring 75 provides an upward bias of media support panel 76 towards pickup roller 31. Recess 79 is formed within the lower portion of paper tray 70. Media support panel 76 provides a surface against which media M is supported. Media support panel 76 includes apertures 78 which provide a free flow of air between recess 79 and media storage bay 47. Desiccant packets 15 are placed in recess 79 below media support panel 76. Ambient air A circulates between recess 79 containing desiccant packets 15 and media storage bay 47.

As seen in FIG. 5, paper tray 70 is inserted against warm air duct 42 and paper tray 70 is pneumatically connected to drying mechanism 25 at inlet 26. Drying mechanism 25 as shown includes heating element 27, blower 28, blower motor 29, and humidity sensor 23, all connected to controller 11. Humidity sensor 23 is connected to controller 11 through contact 24 and is positioned to sense a humidity level in recess 79. When a pre-selected humidity level in recess 79 is equaled or exceeded, heating element 27 and blower motor 29 of blower 28 are energized and warm air H is pressurized passing through paper tray 70 heating and drying desiccant packets 15.

Figure 6:
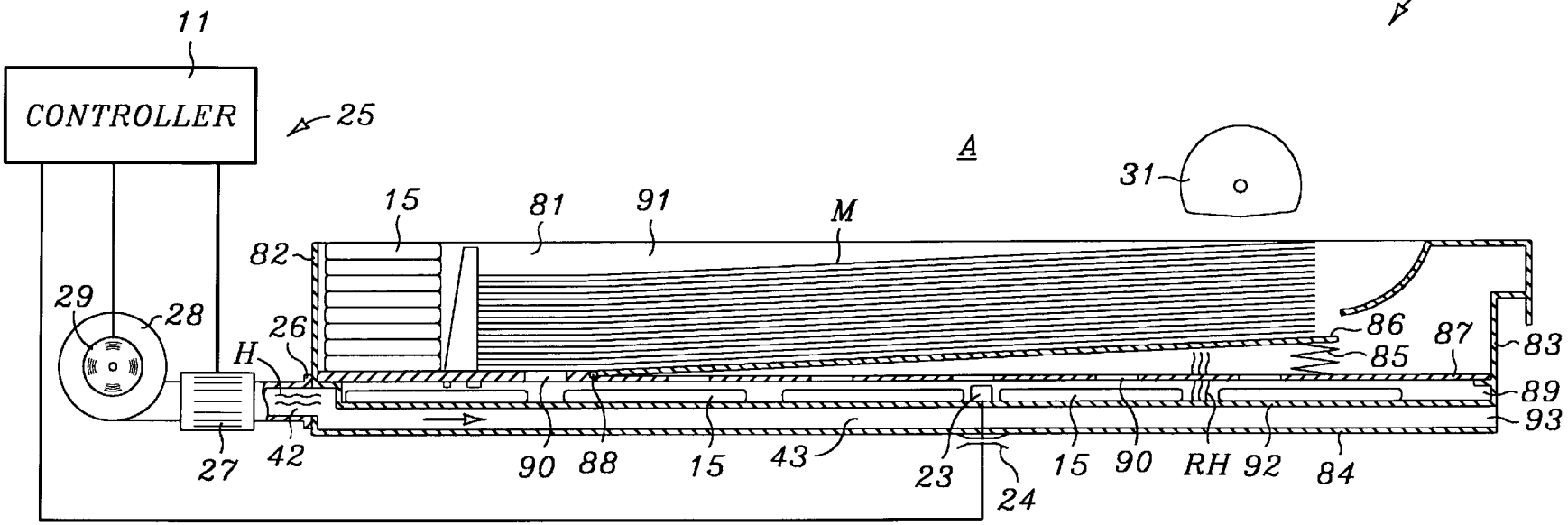
FIG. 6 is a schematic representational side cutaway view of a paper tray including a desiccant and a drying mechanism.

Referring to FIG. 6, an alternate embodiment of the invention is shown generally as paper tray 80. Paper tray 80 includes side wall 81, end wall 82, tray face 83 and base panel 84. Spring 85 is disposed between media support panel 86 and removable panel 87 and is pivotable at hinge 88. Spring 85 provides an upward bias of media support panel 86 towards pickup roller 31. Desiccant packets 15 are placed in recess 89 formed within a lower portion of paper tray 80 below removable panel 87. Removable panel 87 includes apertures 90 which provide a free flow of air between recess 89 and media storage bay 91. Ambient air A circulates freely between recess 89 containing desiccant packets 15 and media storage bay 91 which contains media M.

As seen in FIG. 6 paper tray 80 includes plenum 43 formed below recess 89, extending below radiant surface 92 which forms a partition between recess 89 and plenum 43. Desiccant packets 15 are placed in recess 89 on an upper surface of radiant surface 92. Plenum 43 is pneumatically connected to warm air duct 42 at inlet 26, connecting drying mechanism 25 to paper tray 80. As previously described in reference to FIG. 5, and as shown in FIG. 6, drying mechanism 25 includes heating element 27, blower 28, blower motor 29 and humidity sensor 23, all connected to controller 11. Humidity sensor 23 is connected to controller 11 through contact 24 and is positioned to sense a humidity level in recess 89. When a pre-selected condition is met, for instance switching heating element 27, blower 28 and blower motor 29 to an energized state, warm air H is pressurized passing through inlet 26 to plenum 43 heating radiant surface 92. Radiant heat RH radiates from radiant surface 92 heating and drying desiccant packets 15. Warm air H is discharged from plenum 43 through vent 93.

While heating element 27 is shown in FIGS. 5 and 6 as a dedicated unit it should be recognized by those skilled in the art that any existing heat source, including toner fusers, electronic circuitry and power supplies that radiate or otherwise exhibit a net heat loss during operation, may serve the function intended of heating element 27. Similarly, while blower 28 is shown in FIGS. 5 and 6 as a dedicated unit it should be recognized by those skilled in the art that any existing air displacement unit that is capable of creating an air flow or pressure differential may serve the function intended of blower 28.

While this invention has been described with reference to the detailed embodiments, this is not meant to be construed in a limiting sense. Various modifications to the described embodiments as well as the inclusion or exclusion of additional embodiments will be apparent to persons skilled in the art upon reference to this description. It is therefore contemplated that the appended claims will cover any such modifications or embodiments as fall within the true scope of the invention.

What is claimed is:

1. A moisture-reducing device for print media comprising:

a paper tray for containing and supporting the print media;

a desiccant contained in the paper tray proximate to the print media for absorbing moisture from the environment of the paper tray;

an air passage pneumatically connected to the paper tray;

a heating element pneumatically connected to the air passage; and a blower pneumatically connected to the air passage for pressurizing an air flow across the heating element into the paper tray directing a pressurized air flow across the desiccant for purging accumulated moisture from the desiccant.

2. The moisture-reducing device of claim 1 wherein the desiccant further comprises a silica gel.

3. The moisture-reducing device of claim 1 wherein the desiccant further comprises an activated alumina.

4. The moisture-reducing device of claim 1 wherein the desiccant further comprises a lithium chloride salt.

5. The moisture-reducing device of claim 1 wherein the desiccant further comprises a pre-packaged desiccant.

6. The moisture-reducing device of claim 1 wherein the paper tray is lined with the desiccant.

7. The moisture-reducing device of claim 1 wherein the desiccant further comprises a molded panel.

8. The moisture-reducing device of claim 1 wherein the paper tray further comprises:

a recess formed in the interior of the paper tray; and the desiccant placed in the recess of the paper tray proximate to the print media.

9. The moisture-reducing device of claim 8 further comprising a panel including a plurality of apertures covering desiccant placed in the recess.

10. The moisture-reducing device of claim 1 further comprising a humidity sensor connected to the heating element, the heating element responsive to a signal from the humidity sensor indicating that a moisture level of the desiccant equals a pre-selected moisture level.

11. The moisture-reducing device of claim 1 wherein the heating element further comprises an intermittently operating heating element.

12. An image forming device comprising:

a controller contained within a housing;

a print engine including a developer assembly connected to and operatively responsive to the controller;

a paper tray attachable to the housing for containing and supporting a media;

a media transport mechanism contained within the housing for picking the media from the paper tray and transporting the media through the print engine;

a desiccant contained in the paper tray proximate to the media for absorbing moisture from the environment of the paper tray;

an air passage pneumatically connected to the paper tray;

a heating element positioned within the air passage; and a blower pneumatically connected to the air passage for pressurizing an air flow across the heating element and into the paper tray directing a pressurized air flow across the desiccant purging accumulated moisture from the desiccant.

13. The image forming device of claim 12 further comprising a humidity sensor connected to the heating element, the heating element responsive to a signal from the humidity sensor indicating that a moisture level of the desiccant equals a pre-selected moisture level.

14. The image forming device of claim 12 wherein the heating element further comprising an intermittently operating heating element.

15. The image forming device of claim 12 wherein the heating element operates in response to a signal from the controller responsive to a pre-selected number of image forming cycles.

16. The image forming device of claim 12 wherein the desiccant further comprises a silica gel.

17. The image forming device of claim 12 wherein the desiccant further comprises an activated alumina.

18. The image forming device of claim 12 wherein the desiccant further comprises a lithium chloride salt.

* * * * *